US007559406B2

(12) United States Patent
Hossain

(10) Patent No.: US 7,559,406 B2
(45) Date of Patent: Jul. 14, 2009

(54) ACOUSTIC FLUID MACHINE

(75) Inventor: Mohammed Anwar Hossain, Yokohama (JP)

(73) Assignee: Anest Iwata Corporation (JP)

( * ) Notice: Subject to any disclaimer, the term of this patent is extended or adjusted under 35 U.S.C. 154(b) by 0 days.

(21) Appl. No.: 11/689,142

(22) Filed: Mar. 21, 2007

(65) Prior Publication Data

US 2007/0235252 A1 Oct. 11, 2007

(30) Foreign Application Priority Data

Mar. 23, 2006 (JP) ..... 2006-080146

(51) Int. Cl.
*F01N 1/20* (2006.01)

(52) U.S. Cl. ..... 181/262; 181/259; 181/260; 417/312

(58) Field of Classification Search ..... 181/259, 181/260, 262; 417/312
See application file for complete search history.

(56) References Cited

U.S. PATENT DOCUMENTS 5,515,684 A * 5/1996 Lucas et al. ..... 62/6
6,638,032 B1 * 10/2003 Vanden Brande et al. ... 417/322
6,792,764 B2 * 9/2004 Poese et al. ..... 62/6
2006/0000669 A1 * 1/2006 Kawahashi et al. ..... 181/262
2006/0011411 A1 * 1/2006 Kawahashi et al. ..... 181/262
2006/0013071 A1 * 1/2006 Kawahashi et al. ..... 367/143
2006/0037812 A1 * 2/2006 Kawahashi et al. ..... 181/262
2006/0054382 A1 * 3/2006 Kawahashi et al. ..... 181/262
2006/0054383 A1 * 3/2006 Kawahashi et al. ..... 181/262
2006/0213720 A1 * 9/2006 Kawahashi et al. ..... 181/262

FOREIGN PATENT DOCUMENTS

JP 2006-266202 10/2006

* cited by examiner

*Primary Examiner*—Jeremy Luks
(74) *Attorney, Agent, or Firm*—Ostrolenk Faber LLP

(57) ABSTRACT

In an acoustic fluid machine, an acoustic resonator gradually reduces in diameter towards the top on which a valve device is provided to suck a gas into the resonator. The gas is compressed in the resonator by a circular-plate piston at the lower end of the resonator and discharged via an outlet of the valve device. The piston comprises a rubber plate fixed to the resonator and a metal plate attached on the rubber plate.

8 Claims, 5 Drawing Sheets

PRIOR ART

ACOUSTIC FLUID MACHINE

BACKGROUND OF THE INVENTION

The present invention relates to an acoustic fluid machine, the machine utilizing fluctuations in pressure amplitude based on acoustic resonance.

In JP2006-266202A, there is an acoustic fluid machine in which a vibrating plate which reciprocates at high speed axially with a very small amplitude by driving sound source is provided on the inside of a larger-diameter base of an acoustic resonator, and a gas is taken into the acoustic resonator and discharged therefrom via a smaller-diameter upper end by virtue of pressure fluctuations within the acoustic resonator by reciprocation of the vibrating plate.

This acoustic fluid machine utilizes fluctuations in the pressure amplitude of standing acoustic waves generated by the phenomenon of resonance of a gas column inside the resonator by the piston when the piston is made to reciprocate axially with a very small amplitude, and comprises as an operating part only an actuator that reciprocates vibrating plate provided in the base of the acoustic resonator at high speed.

For reference, a typical structure of the acoustic fluid machine in JP2006-266202A will be described with reference to FIG. 5.

In the acoustic fluid machine, an actuator 32 is mounted in a larger-diameter portion at the lower end or the base of an acoustic resonator 31, and a valve device 33 is mounted in a smaller-diameter upper end of the acoustic resonator 31.

The acoustic resonator 31 has a resonant cavity 34 having a larger-diameter lower end and the diameter gradually decreases toward the top.

The actuator 32 also functions as a support, and includes a circular-plate piston 36 on the upper face thereof. The piston 36 is vibrated up and down by an appropriate vibration unit (not shown) via a reciprocation vibrating rod 35. The piston 36 is made of a light alloy and is fitted in the lower end of the resonant cavity 34. The outer circumference of the piston 36 has an annular groove 37 in which an O-ring 38 is fitted for sealing.

The acoustic resonator 31 has an outward flange 39 at the lower end. The outward flange 39 is disposed on the upper surface of the actuator 2, and the outward flange 39 and the actuator 32 are secured to each other by means of an appropriate number of bolts 40.

The valve device 33 is provided with an intake chamber 45 and a discharge chamber 49 that are arranged in line. The intake chamber 45 is equipped with an inlet 41 on one side of the valve device 33 and an intake hole 44 in the lower face of a bottom wall 42, with an inward check valve 43 for taking in external air, and the discharge chamber 49 is equipped with an outlet 46 on the other side of the valve device 33 and a discharge hole 48 in the upper face of the bottom wall 42, with an outward check valve 47 for discharging compressed air.

The inward and outward check valves 43 and 47 are formed from a reed valve or a rubber sheet valve made of, for example, a thin steel sheet. The valves 43, 47 are secured at one end to the lower side of the bottom of the intake chamber 45 and the upper side of the bottom of the discharge chamber 49, respectively. However, they may be of a ball type or any other type.

The valve-opening resistance of the outward check valve 47 is set so as to be considerably larger than that of the inward check valve 43.

The intake chamber 45 and the discharge chamber 49 are partitioned by a wall 50.

When the piston 36 reciprocates with a very small amplitude axially in the larger-diameter base at the lower end of the acoustic resonator 31 to allow the pressure amplitude within the acoustic resonator 31 to become a very small value, external air is taken in via the inlet 41, flows into the intake chamber 45, and is sucked into the acoustic resonator 31 via the intake hole 44 and the inward check valve 43. When the pressure amplitude within the acoustic resonator 31 becomes very small value, the air is discharged under compression from the acoustic resonator 31 via the discharge hole 48, the outward check valve 47, the discharge chamber 49 and the outlet 46.

Thus, the acoustic fluid machine has a very simple structure, has the advantage that a possibility of malfunction is very small, and can be used for various applications.

In the acoustic fluid machine described above, the flexible seal ring such as an O-ring is fitted in the annular groove in the outer circumferential surface of the piston in the acoustic resonator, the piston reciprocates axially with a very small amplitude at a sliding area of the seal ring in the acoustic resonator to generate sine waves thereby compressing the gas in the acoustic resonator.

However, in a usual acoustic fluid machine, as the amplitude of the seal ring is about 100-500 μm and the piston performs very small reciprocations at about 1000 times a second, only a certain portion of the seal ring bumps and wears locally, resulting in a leakage from the portion.

Therefore, the acoustic fluid machine performs badly and can not be used.

The seal ring inherently has frictional resistance, and the resistance and frictional heat increase when it is subjected to high-frequency vibration, affecting each of members harmfully, increasing load to the actuator as a sound-driving source, and decreasing the performance and durability.

When the seal ring is operated for a long time, it wears locally, bumps unevenly, or deteriorates, thereby causing heated gas to leak via the portion, making into performance poorer.

SUMMARY OF THE INVENTION

It is an object of the present invention to provide an acoustic fluid machine in which vibration by an actuator is appropriately transmitted in an acoustic resonator to compress a gas without a seal ring.

BRIEF DESCRIPTION OF THE DRAWINGS

The features and advantages of the present invention will become more apparent from the following description with respect to embodiments as shown in appended drawings wherein.

DETAILED DESCRIPTION OF THE INVENTION

Figure 1:
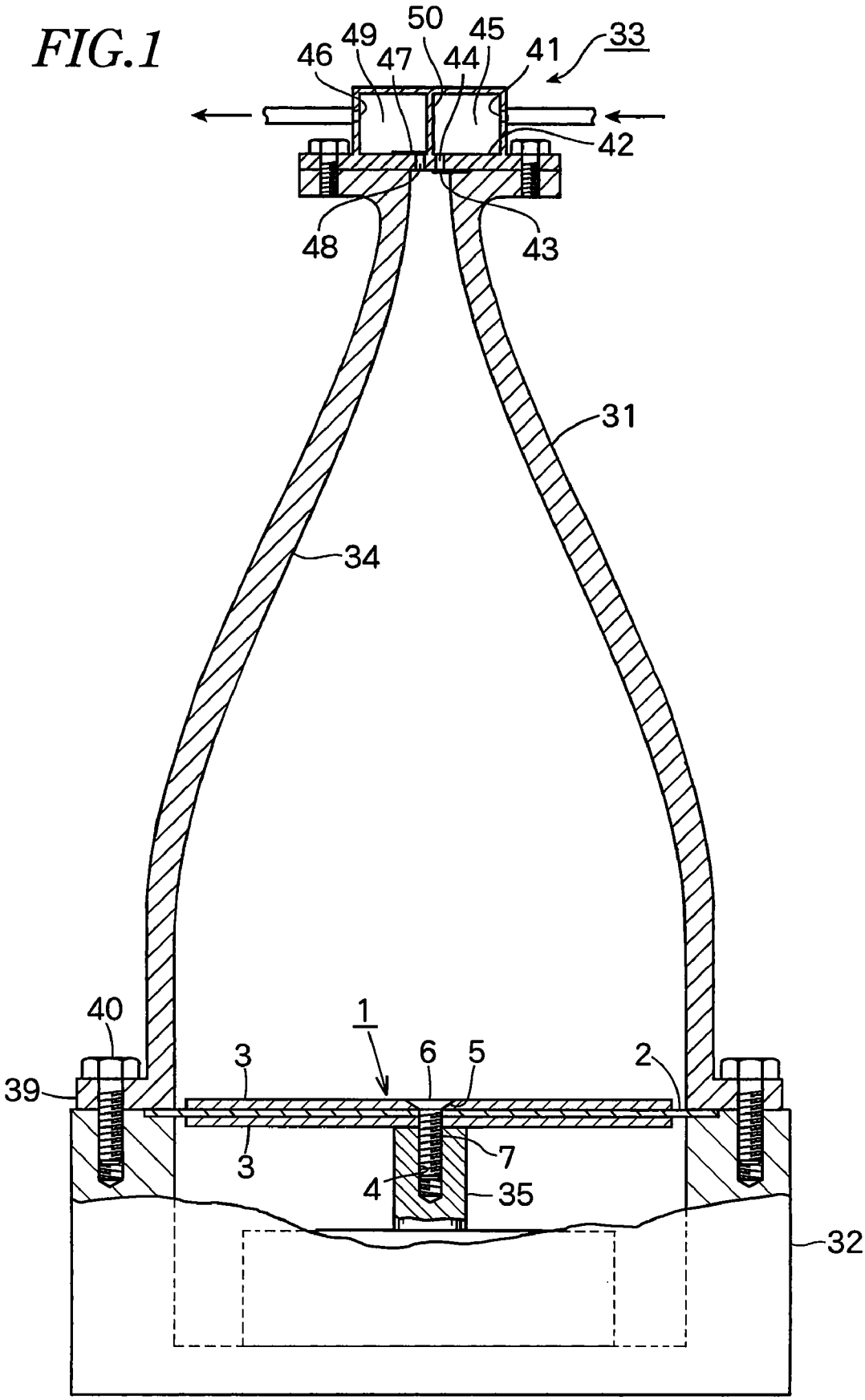
FIG. 1 is a vertical sectional view of the first embodiment of an acoustic fluid machine according to the present invention.
Figure 5:
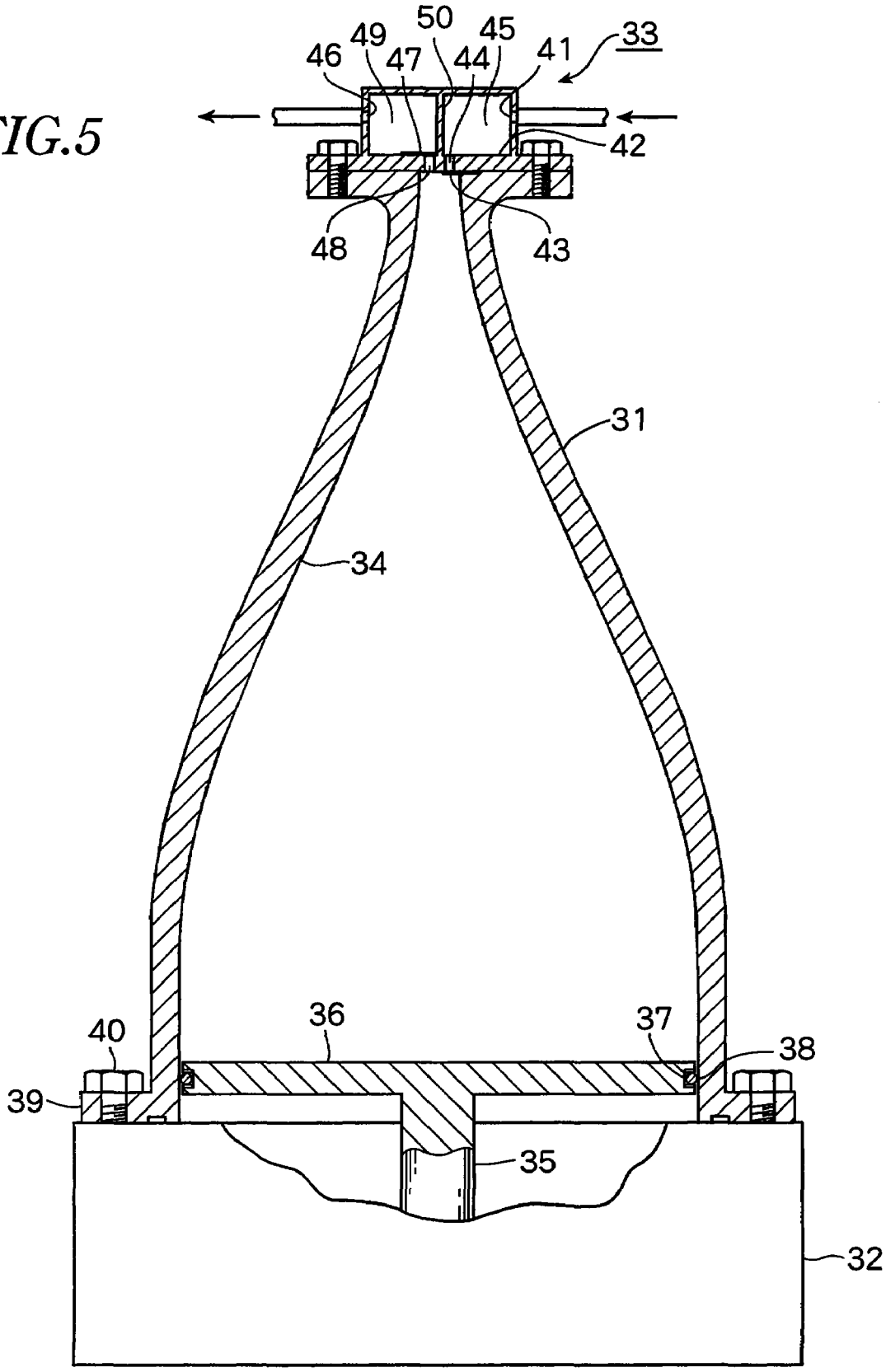
FIG. 5 is a vertical sectional view of a known acoustic fluid machine.

FIG. 1 is a vertical sectional view of an acoustic fluid machine according to the present invention, in which the same numbers are attached to the same members in FIG. 5 and a detailed description is omitted.

In FIG. 1, a circular-plate piston 1 is supported by a reciprocation vibrating rod 35 in an actuator 32, and a piston 1 comprises a rubber plate 2 and metal plates 3, 3 made of Al or stainless steel which are superimposed on both sides of the rubber plate 2. The performance of the acoustic fluid machine would not be degraded by flattening surfaces of the metal plates 3, 3 so as not to make acoustic waves turbulent in the acoustic resonator 31.

The circumference of the rubber plate 2 is interposed between the actuator 32 and the outward flange 39 at the bottom of the acoustic resonator 31 and fixed by a plurality of bolts 40 inserted in the outward flange 39.

A metal plate 3 may be provided on one side of the rubber plate 2.

Metal plates 3, 3 are fixed to the rubber plate 2 with an adhesive or by firing.

Experiments proved that the best results had been obtained by setting diameters of the metal plates 3, 3 at 80-90% of that of the rubber plate 2 in the acoustic resonator 31.

The circular-plate piston 1 is fixed to the reciprocation vibrating rod 35 by a flat head screw 6 inserted in a countersink 5 formed at the center of the piston 1, by which a male thread 7 of the flat head screw 6 is screwed into a tapped hole 4 of the reciprocation vibrating rod 35 of the actuator 32.

Figure 2:
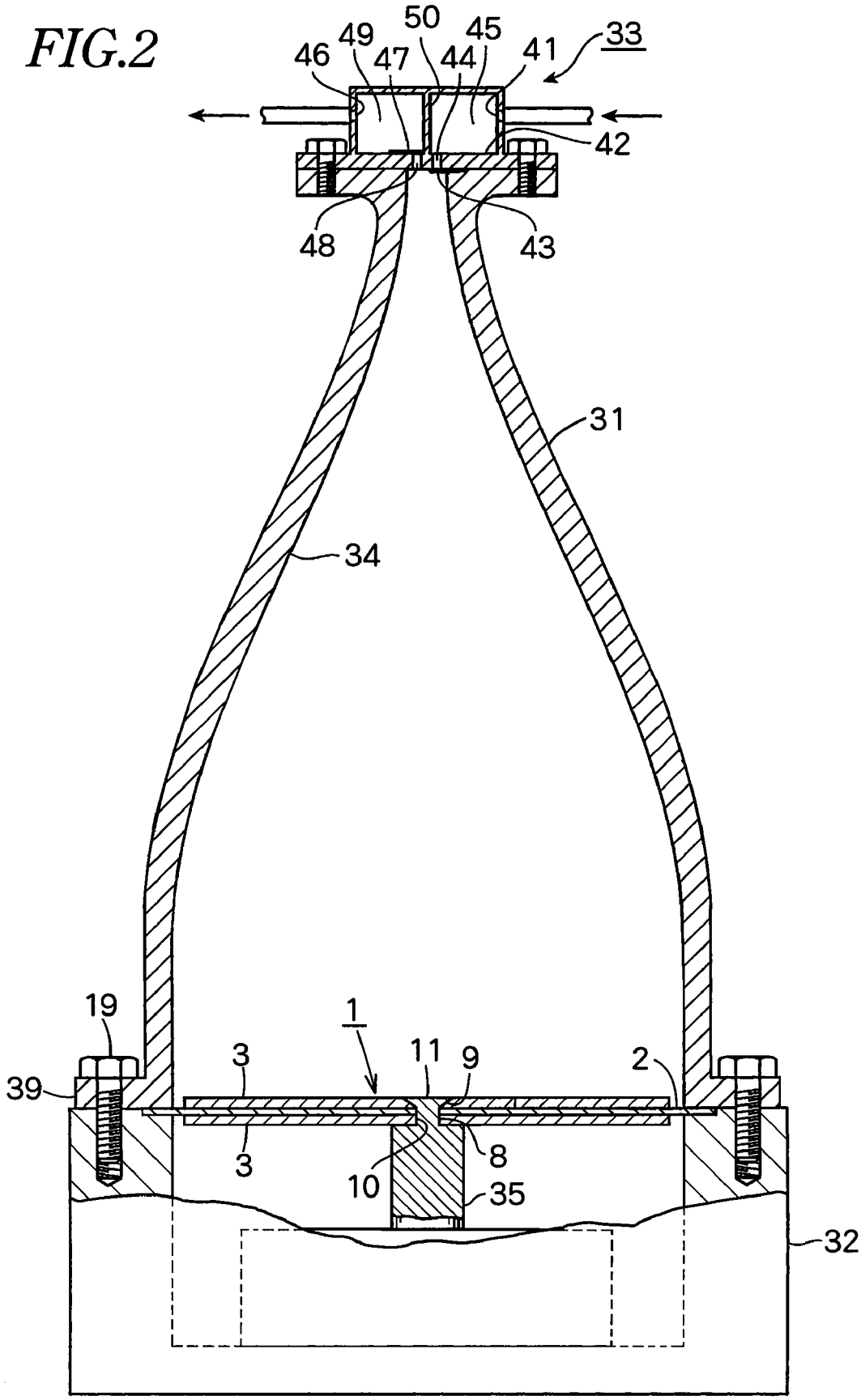
FIG. 2 is a vertical sectional view of the second embodiment thereof.

In the second embodiment in FIG. 2, a reciprocation vibrating rod 35 has smaller-diameter portion 8 at the upper portion and a flat head portion 11. The smaller-diameter portion 8 is inserted into an attachment hole 10 of the piston 1 which has a countersink 9 formed on the hole 10 at the center of the piston 1 from a bottom, and the upper end of the smaller-diameter portion 8 is calked to form the flat head portion 11 which closes the countersink 9.

In both cases, the upper surface of the flat head screw 6 or the flat head portion 11 is completely coplanar with the upper surface of the piston 1.

Figure 3:
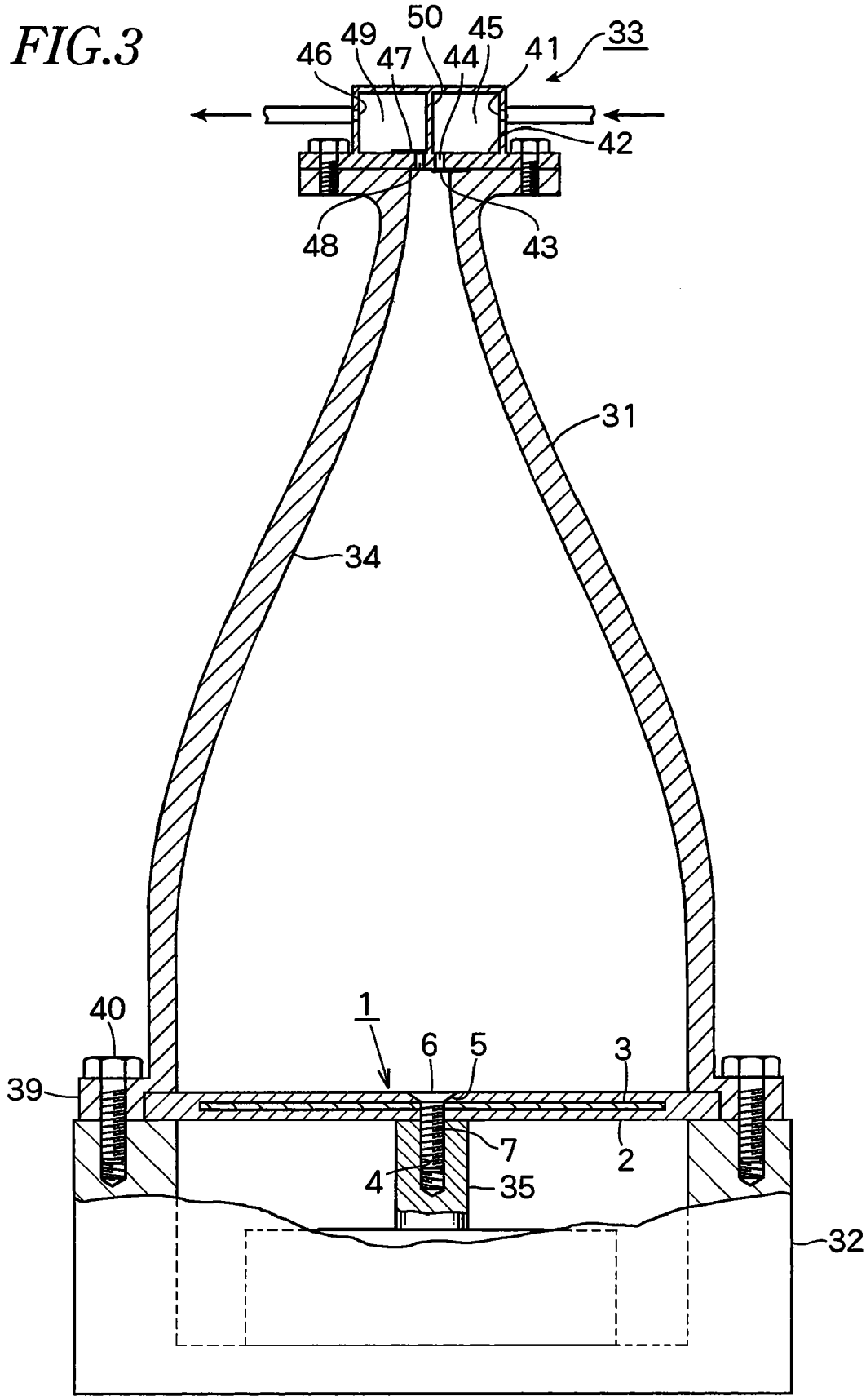
FIG. 3 is a vertical sectional view of the third embodiment thereof.

FIG. 3 shows the third embodiment of the present invention in which a flat metal plate 3 which is smaller in diameter than a rubber plate 2 is embedded in the rubber plate 2.

Figure 4:
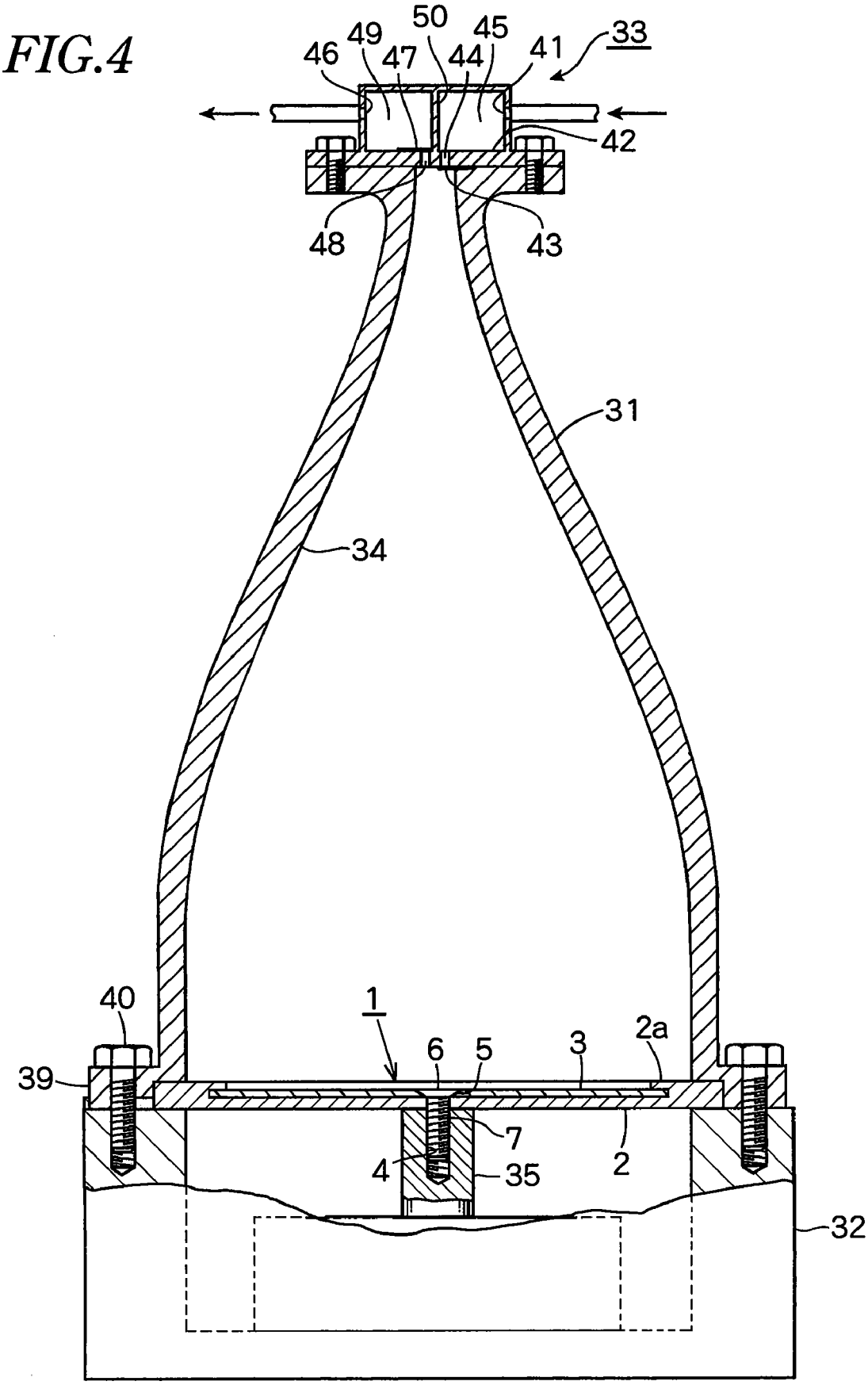
FIG. 4 is a vertical sectional view of the fourth embodiment thereof.

FIG. 4 shows the fourth embodiment of the present invention in which the circumference of the metal plate 3 is fitted between a rubber plate 2 and an inward flange 2*a* which is smaller in diameter than the rubber plate 2.

The foregoing merely relates to embodiments of the present invention. Various modifications and changes may be made by a person skilled in the art without departing from the scope of claims.

What is claimed is:

1. An acoustic fluid machine comprising:

an acoustic resonator comprising a larger-diameter base at a lower end and a smaller-diameter upper end;

a circular-plate piston that vibrates axially at high speed with very small amplitude in the base of the acoustic resonator, said piston comprising a rubber plate fixed at its periphery to the acoustic resonator and a metal plate on the rubber plate; and a valve device mounted on the upper end of the acoustic resonator and having an inlet for sucking a gas into the acoustic resonator and an outlet for discharging the gas after compression in the acoustic resonator.

2. An acoustic fluid machine of claim 1 wherein the metal plate is fixed on each side of the rubber plate.

3. An acoustic fluid machine of claim 1 wherein the metal plate is adhered to the rubber plate with an adhesive.

4. An acoustic fluid machine of claim 1 wherein the metal plate is fixed by firing.

5. An acoustic fluid machine of claim 1, further comprising a reciprocation-vibrating rod that is fixed to a center of the piston by a bolt to vibrate the piston.

6. An acoustic fluid machine of claim 1 wherein the metal plate is embedded in the rubber plate.

7. An acoustic fluid machine of claim 1 wherein the rubber plate has an inward flange, the metal plate being disposed between the inward flange and the rubber plate.

8. An acoustic fluid machine of claim 1 wherein the metal plate is between 80%-90% of the rubber plate in diameter.

* * * * *